United States Patent [19]

Arber

[11] Patent Number: 4,630,934

[45] Date of Patent: Dec. 23, 1986

[54] CALENDAR WITH INDICATING MEANS

[76] Inventor: Amihadar Arber, 13 Mendele Street, Tel-Aviv, Israel

[21] Appl. No.: 827,750

[22] Filed: Feb. 10, 1986

[51] Int. Cl.[4] ..... G04B 19/24; G09D 3/00

[52] U.S. Cl. ..... 368/28; 40/107

[58] Field of Search ..... 368/28, 29, 41, 42, 368/43, 10, 72–74, 250; 40/107, 110

[56] References Cited

U.S. PATENT DOCUMENTS

| | | | |
|---|---|---|---|
| 3,276,198 | 10/1966 | Barbera | 368/28 |
| 3,464,200 | 9/1969 | Merrick | 368/28 |
| 3,817,022 | 6/1974 | Swartz | 368/41 |
| 4,162,610 | 7/1979 | Levine | 368/28 |
| 4,194,196 | 3/1980 | Mohiuddin | 368/29 |
| 4,303,995 | 12/1981 | Aizawa | 368/28 |
| 4,472,894 | 9/1984 | Wightman | 40/107 |

*Primary Examiner*—Vit W. Miska

*Attorney, Agent, or Firm*—Silverman, Cass, Singer & Winburn, Ltd.

[57] ABSTRACT

An electronic, attention attracting calendar including a base having a front surface exhibiting conventional calendar information indicia, means associated with the front surface for lighting selected areas thereon, circuit means for selectively activating and de-activating the lighting means to light at least one of the selected areas, and control and memory means for programming the circuit means.

11 Claims, 2 Drawing Figures

CALENDAR WITH INDICATING MEANS

BACKGROUND OF THE INVENTION

The present invention relates generally to an electronic, attention attracting calendar and more particularly to a monthly calendar with daily "jot-down" areas having attention attracting means associated with each of the areas.

This calendar will attract attention to specific preprogrammed dates in a visual and optionally also in an audible way and furthermore, will provide advanced warnings up to a few days prior to the selected dates in a distinguishing visual and/or audible way. Personal computers provide means of storing and retrieving events on a daily basis, but they lack the most important feature of manual entries made by a common writing instrument without the use of an alpha-numeric keyboard. Consequently, people still prefer the conventional paper calendars which provide ease of entering and an instant visual indication of events to come. This invention therefore provides the ordinary person with a simple, inexpensive and most important, with a calendar of a familiar format, in which the user can jot down important events and actually, see the dates approaching. Also the electronic calendar of the present invention can be used in the years to come by merely inserting a new 12 sheet calendar refill each year.

SUMMARY OF THE INVENTION

In accordance with the invention there is provided an electronic, attention attracting calendar comprising a base having a front surfac exhibiting conventional calendar information indicia;

means associated with said front surface for lighting selected areas thereon;

circuit means for selectively activating and deactivating said lighting means to light at least one of said selected areas, and control and memory means for programming said circuit means.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE INVENTION

Figure 1:
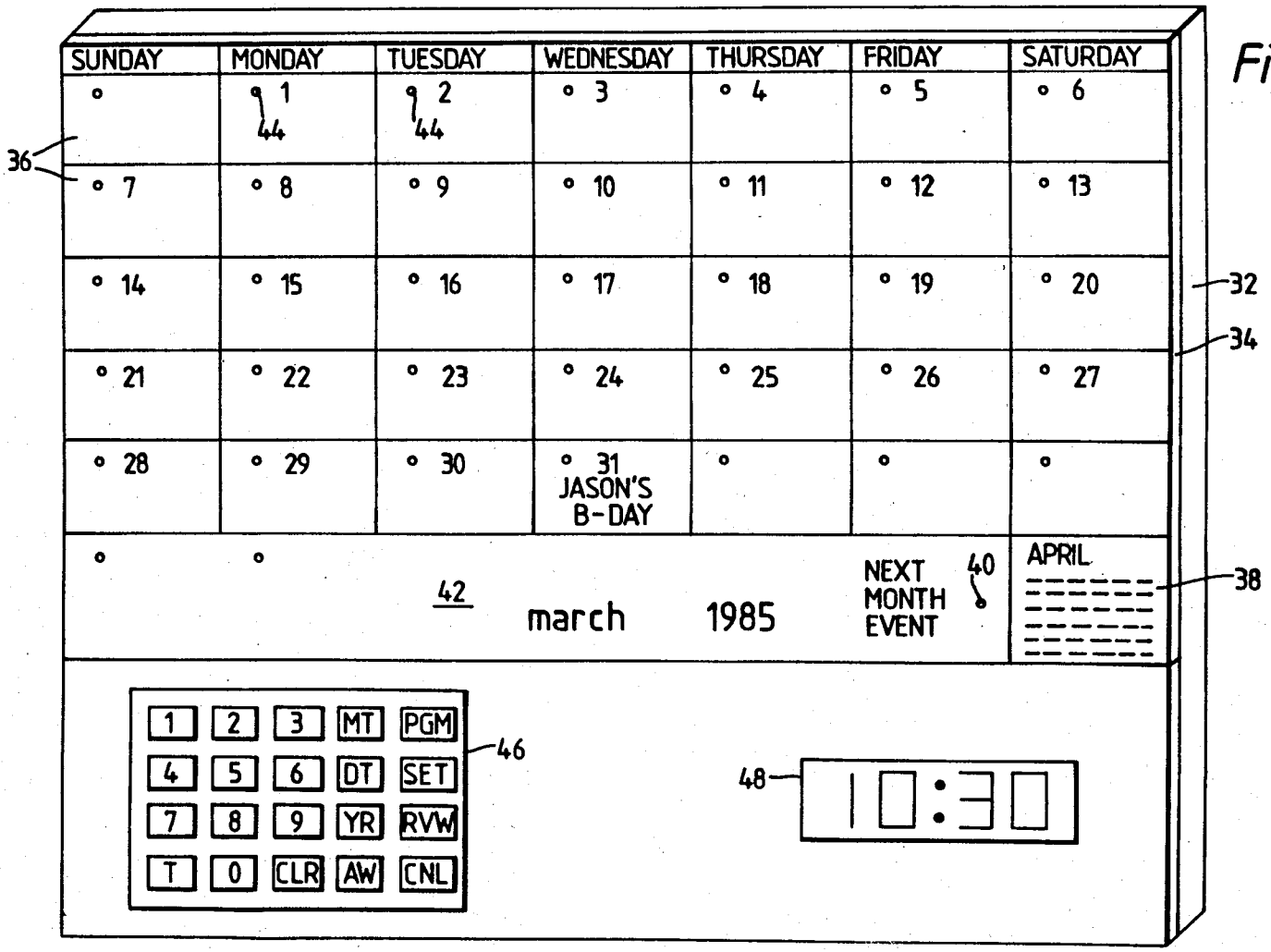
FIG. 1 is a schematic front view of a preferred embodiment of a calendar according to the present invention.

There is seen in FIG. 1 a preferred embodiment of the calendar according to the invention which comprises a base 32 on the front surface of which there is removably affixed a sheet 34 exhibiting standard calendar information indicia. In the shown embodiment the indicia includes either preprinted or jotted-down information relating to the days of the week and the dates of the particular month shown. The dates of the month are depicted within the boundaries of marked areas 36. Advantageously, there is also provided an area 38 displaying calendar information with regard to the month following the particularly displayed month. The sheet 34 has a further defined field 42 in which the name of the displayed month and year are depicted and may include further desired information.

The removably interchangeable sheet 34 may be provided without the designation of the days of the week appearing at the top line thereof. Instead, this information may be permanently written on the base 32 or even more advantageously, it may be depicted on a resilient strip of material which can serve as a clamp for affixing of the periodically changeable sheet 34.

As further seen in the figure, each of the areas 36 includes a light emitting element 44, for example, light emitting diodes (LED's) strategically mounted on the base 32 so as to partly protrude through apertures correspondly provided in the sheet 34, when the latter is correctly affixed on the base.

The sheet 34 is preferably made of paper to enable the user to write thereon as is done on any suitable conventional jot-down calendar. Alternatively, the sheet 34 may be made of at least semi-transparent material, such as plastic, on which surface it is also possible to write, however, with selectable suitable writing instruments.

When the sheet 34 is made of at least semi-transparent material, the areas 36 need not be provided with apertures for allowing the elements 44 to protrude therethrough. The elements may, in this case, be embedded in, or otherwise affixed on, the base 32 and the light eventually emitted by said elements will be noticeable through the transparent sheet placed thereon. Obviously, the intensity of light emitted by each individual LED will be calculated with respect to the size of each individual area so as to assure that the viewer will immediately be able to perceive the specific date and/or the hand written information to which attention is to be drawn.

Figure 2:
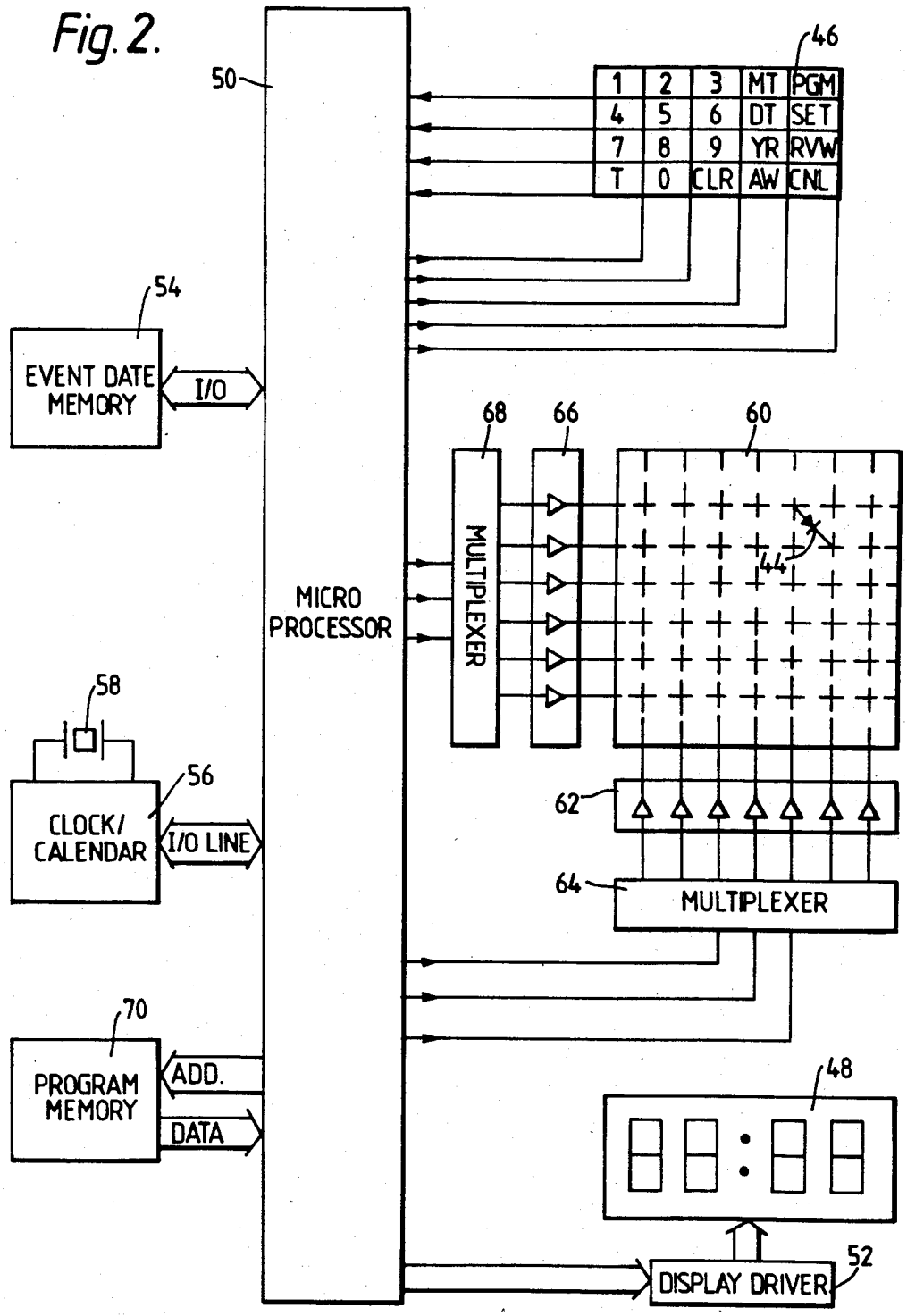
FIG. 2 is an electronic diagram of an arrangement of light emitting elements and their associated circuits and components as used in the calendar of FIG. 1.

The base 32 is further provided with a keyboard 46 incorporating keys bearing numerical and alphabetical indicia 0–9, T, CLR, MT, DT, YR, CL, AW, PGM, SET, RVW and CNL, and with an LC display 48. The abbreviations on the keys denote as follows:

MT—enters month
DT—enters date
YR—enters year
AW—advanced warning entry
CLR—clears prior entries
T—enters start-up time
SET—made to set the start-up date and time
PGM—program mode to enter future dates into calendar's memory
RVW—review mode—to review future date entries
CNL—cancel mode—to cancel any date entry Turning now to FIG. 2, there is seen the 4×5 matrix keyboard 46 which is electronically connected to a micro-processor 50. Entries are viewed on LC display 48 which is connected to the micro-processor 50 through a display driver 52. All event dates which are entered by means of the keyboard are stored in the event date memory chip 54. The micro-processor 50 keeps track of time and dates by constantly referring to clock/calendar unit 56, which unit in turn, is controlled for accuracy by a quartz crystal 58. The light emitting elements 44 are connected to a 6×7 light emitting element matrix 60, the latter being connected to, and controlled by, the micro-processor through column drivers 62 and multiplexer 64, on one side, and through row drivers 66 and multi-plexer 68, on the other side. The program memory is designated by the numeral 70.

The operation of the calendar is as follows: the calendar is first energized by a battery or from a common household wall outlet and then set, by means of the clock/calendar unit 56. This setting will provide accurate time base and keep track of dates until, e.g., the year 2010, including leap years. If, for example, the start-up date is Mar. 5, 1985, and the time is 10:30 A.M., the key-pressing sequence is as follows: SET, 3, MT, SET, 5, DT, SET, 85, YR, SET, 1030. T. This completes the initial start-up of the calendar. At this point the LC display 48 will show the actual time of the day (10:30 A.M.), and pressing key DT will show on the display the actual date (3-5-85). It should be noted that each and every entry made through the keyboard will be shown on the LC display in order to be able to monitor the entries and prevent errors. In case of an error, the user presses the key designated CLR, this clears the entry and provides for a new, correct entry. When the user wants to be reminded of an important event, e.g., "Jason's birthday" that will occur on Mar. 31, 1985, (see FIG. 1) the user will then press keys PGM, 3, MT, 31, DT, 85, YR. If the user wants an advanced warning of 2 days, he then presses keys 2, AW. The result will be that the light emitting element associated with the selected date will start blinking at a slow rate on March 29, the blinking rate will increase on March 30 and the light emitting element will stay lit on March 31. On April 1—the light emitting element will turn off. Pressing keys 1, AW, immediately, after date-entering procedure will provide a one day advanced warning. Similarly, pressing the keys 3, AW, will provide three days advanced warning. Pressing just the key AW will provide no advanced warning. In this respect, it should be noted that the area 38 showing the entire calendar layout of the next month, and/or of the adjacently located attention attracting "NEXT MONTH EVENT" light emitting element 40, which is activated to draw attention to an event which will occur in the first days of the forthcoming month, is useful for allowing sufficient advance warning of an upcoming event. The advance warning signalling of the "NEXT MONTH EVENT" light 40 will stop on the first of the new month. Hundreds of upcoming dates can thus be programmed in advance in the above described manner. If the user wants to cancel, e.g., the Mar. 31, 1985 entry, he then presses keys PGM, 3, MT, 31, DT, 85, YR and CNL. Any particular programmed date can be cancelled by merely entering the desired date and then pressing key CNL.

Another unique feature according to this invention is the ability to enter dates, which are repeated each year, such as birthdays, anniversaries, memorials, etc. only once. This is accomplished by entering the date, but skipping any reference to year. For example, if a child's birthday falls on October 17, and advanced warning of one day is required, then, the key pressing sequence is: PGM, 10, MT, 17, DT, YR, 1 and AW. This sequence will enter the child's birthday into the calendar's memory in each and every year until 2010.

A still additional feature according to this invention is the ability to review the entered dates either in chronological order or according to designated years. As an example, say, the user wants to review entries for 1988, he then presses the keys: RVW and 88. Now, each pressing of the RVW key will cause the LC display 48 to exhibit the 1988 entries, starting in the beginning of January and ending in the end of December.

It will be readily appreciated that the electronic calendar described in accordance with the present invention, constitutes a simple and effective way of being reminded of, and of keeping up with, important upcoming events through attention attraction visual and/or audible means, which means, in turn, are part of the familiar and conventional jot-down calendar.

In addition to the visual signals which are displayed on the calendar's face, an audible signal could also be provided in a manner similar to the visual and selectively audible beeping signals which are common in the widespread digital watches. The audible signal may also be of decreasing time between beeps similar to the visual signals of changing rates.

It is important to note that today's integrated circuits technologies enable to compound all the circuit elements of the event memory, program memory, clock/calendar, the multiplexers, and the micro-processor in a single chip.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electronic, attention attracting calendar comprising a base having a front surface for exhibiting conventional calendar information indicia;

means associated with said front surface for lighting through selected areas thereon;

said front surface is adapted to have a plurality of interchangeable paper sheets mounted thereon, such as a yearly calendar refill, each interchangeable paper sheet, divided into defined monthly date areas bearing a calendar information indicia in a small portion thereof and at least the majority of said areas each include an aperture through the sheet in a second small portion thereof at a predetermined location for registering with each other sheet and revealing said lighting means individually through each aperture, said apertures and indicia leaving a large portion of said areas for accommodating jotted-down information;

circuit means for selectively activating and deactivating said lighting means to project light through at least one of said selected areas, and control and memory means for programming said circuit means.

2. The calendar as claimed in claim 1, wherein said means associated with the front surface are LED's arranged in a matrix on said base aligned with said apertures in said defined areas and mounted on said base to at least partially protrude through said apertures.

3. The calendar as claimed in claim 1, wherein said control means for programming said circuit means includes a keyboard having a plurality of individual keys, each bearing indicia selected from the group comprising the numerals zero to nine and indicia denoting the functions of entering dates and advanced warning dates, and the functions for setting, clearing and cancelling date entries.

4. The calendar as claimed in claim 1 further comprising a display for exhibiting information including information entered into said memory means.

5. The calendar as claimed in claim 1 further comprising means for producing audible signals for attracting attention on specific dates.

6. The calendar as claimed in claim 1, further including means providing an advanced warning of a preselected event date.

7. The calendar as claimed in claim 6, wherein said means include means for causing said lighting means to be activated at a selected blinking rate on a date preceding said event date.

8. The calendar as claimed in claim 1, further including means for providing a warning of a preselected event date occurring in the month immediately following the month being displayed by said paper sheet.

9. The calendar as claimed in claim 8, wherein said means include a special aperture in said sheets separate from said indicia areas and means for causing said lighting means to be activated to be revealed through said special aperture.

10. For use with an electronic, attention attracting calendar, a plurality of stacked calendar sheets, each divided into defined areas bearing calendar information indicia in a small portion thereof, which areas are adapted to accommodate jotted-down information, at least the majority of said areas including an aperture made in said defined areas at a predetermined location in a second small portion of said area for revealing light display means individually through each sheet.

11. The plurality of stacked calendar sheets as claimed in claim 10, wherein each said sheet comprises a monthly calendar and includes a special apertures separate from said indicia areas for indicating a special preselected event occurring in a month sheet immediately following the month sheet currently being displayed.

* * * * *